US007805798B2

(12) United States Patent
Belanger

(10) Patent No.: US 7,805,798 B2
(45) Date of Patent: Oct. 5, 2010

(54) THERMOFORMED MEDIA FOR CAR WASH EQUIPMENT AND METHODS OF BUILDING AND OPERATING CAR WASH EQUIPMENT USING SUCH MEDIA

(75) Inventor: Michael J. Belanger, Novi, MI (US)

(73) Assignee: Belanger, Inc., Northville, MI (US)

( * ) Notice: Subject to any disclaimer, the term of this patent is extended or adjusted under 35 U.S.C. 154(b) by 1015 days.

(21) Appl. No.: 11/528,876

(22) Filed: Sep. 28, 2006

(65) Prior Publication Data

US 2008/0078048 A1 Apr. 3, 2008

(51) Int. Cl.
*B60S 3/06* (2006.01)

(52) U.S. Cl. ..... 15/230.16; 15/53.2; 15/97.3

(58) Field of Classification Search ..... 15/97.3, 15/230, 53.2, 230.13, 230.14, 230.15, 230.16, 15/230.19; 40/124.13, 493, 388; *A47L 7/02; A46D 1/00; B60S 3/06*

See application file for complete search history.

(56) References Cited

U.S. PATENT DOCUMENTS 449,239 A * 3/1891 Webster ..... 15/230.16
4,338,698 A * 7/1982 Beer et al. ..... 15/230.16
5,946,761 A 9/1999 Ennis
6,279,190 B1 * 8/2001 Belanger et al. ..... 15/230.16
6,795,996 B2 * 9/2004 Ennis et al. ..... 15/97.3
2004/0010878 A1 * 1/2004 Levesque ..... 15/230.16
2005/0268412 A1 12/2005 Pecora
2006/0048324 A1 3/2006 Vassilopoulos
2006/0075590 A1 4/2006 Holbus
2006/0207047 A1 * 9/2006 Weyandt ..... 15/230.13

FOREIGN PATENT DOCUMENTS

EP 875171 A1 * 11/1998

* cited by examiner

*Primary Examiner*—Monica S Carter
*Assistant Examiner*—Stephanie Newton
(74) *Attorney, Agent, or Firm*—Young Basile Hanlon & MacFarlane, PC

(57) ABSTRACT

A car wash brush comprises an axial core structure and a plurality of foam plastic media sheets attached to the core structure in angularly spaced relationship to one another. The media sheets are preferably made of closed cell, low absorbtivity foam plastic material between about ⅛ and ½ inch thick and thermoformed into a pleated configuration with a surface pattern of raised and recessed geometric figures. The media sheets are split at least partially into individual pliant fingers.

4 Claims, 5 Drawing Sheets

THERMOFORMED MEDIA FOR CAR WASH EQUIPMENT AND METHODS OF BUILDING AND OPERATING CAR WASH EQUIPMENT USING SUCH MEDIA

FIELD OF THE INVENTION

This invention relates to the design, manufacture and use of sheet-like media for car wash equipment including rotating brushes and more particularly to a media comprising partially subdivided sheets of foam plastic material in which the parallel vehicle contacting fingers are made non-planar so as to be essentially self-supporting regardless of orientation or kinetic effects.

BACKGROUND OF THE INVENTION

It is known to use various materials including thin polypropylene strands, strips of synthetic felt, and sheets of thin plastic fabric in the manufacture, repair and operation of car wash equipment including rotating brushes and hanging mitter curtains. More recently it has become known to use sheets of closed cell foam plastic material because of its lower water absorbtivity, a characteristic which makes the material lighter in weight when wet.

A convenient structure for the assembly of rotating car wash equipment including brushes using closed cell foam plastic media is disclosed in U.S. Pat. No. 6,279,190 issued Aug. 28, 2001, the complete disclosure of which is incorporated by reference into this document.

There remains, however, a concern for the endurance of the foam plastic material, the effectiveness of its washing action and the noise generated by the sound of the individual sheets or strips of media in a multi-sheet rotating brush slapping against the side or top surface of the vehicle being washed.

SUMMARY OF THE INVENTION

A first aspect of the present invention is a sheet-like media for car wash equipment including but not limited to brushes wherein the media comprises at least one sheet of foam plastic material configured to define parallel fingers adopted to make contact with a vehicle being washed. In accordance with the invention, each of the fingers is formed in a non-planar configuration such that the fingers tend to be self-supporting and shape-maintaining irrespective of orientation. The non-planarity can be achieved in any of several ways; e.g., the fingers can be longitudinally folded or "pleated" in a thermoforming operation, can be made semicircular, can be embossed in the thermoforming operation with a pattern of raised and depressed surfaces, or can be impressed with a combination of these features. For example, the fingers can be both pleated and embossed. The embossing can be in the form of geometric figures such as squares or circles, straight, parallel or intersecting lines, wavy lines and so on.

In accordance with another aspect of the invention, a car wash brush utilizing the media described above in multiple sheets and assembled to a vertical support is provided. The vertical support may, for example, be of the type described in the aforementioned U.S. Pat. No. 6,279,190, but may take any of several other forms capable of being mounted on an axle which is rotated by a suitable motor.

Additional aspects of the invention include a method of building a car wash brush or other implement in the manner described above and a method of operating a rotating brush assembled in the manner described above.

The preferred material is a closed cell foam plastic with a thickness of between ¼" and ½", the typical thickness being about 3/16". When pleated, the individual fingers have a width at least double the material thickness.

DETAILED DESCRIPTION OF THE ILLUSTRATIVE EMBODIMENT

Figure 1:
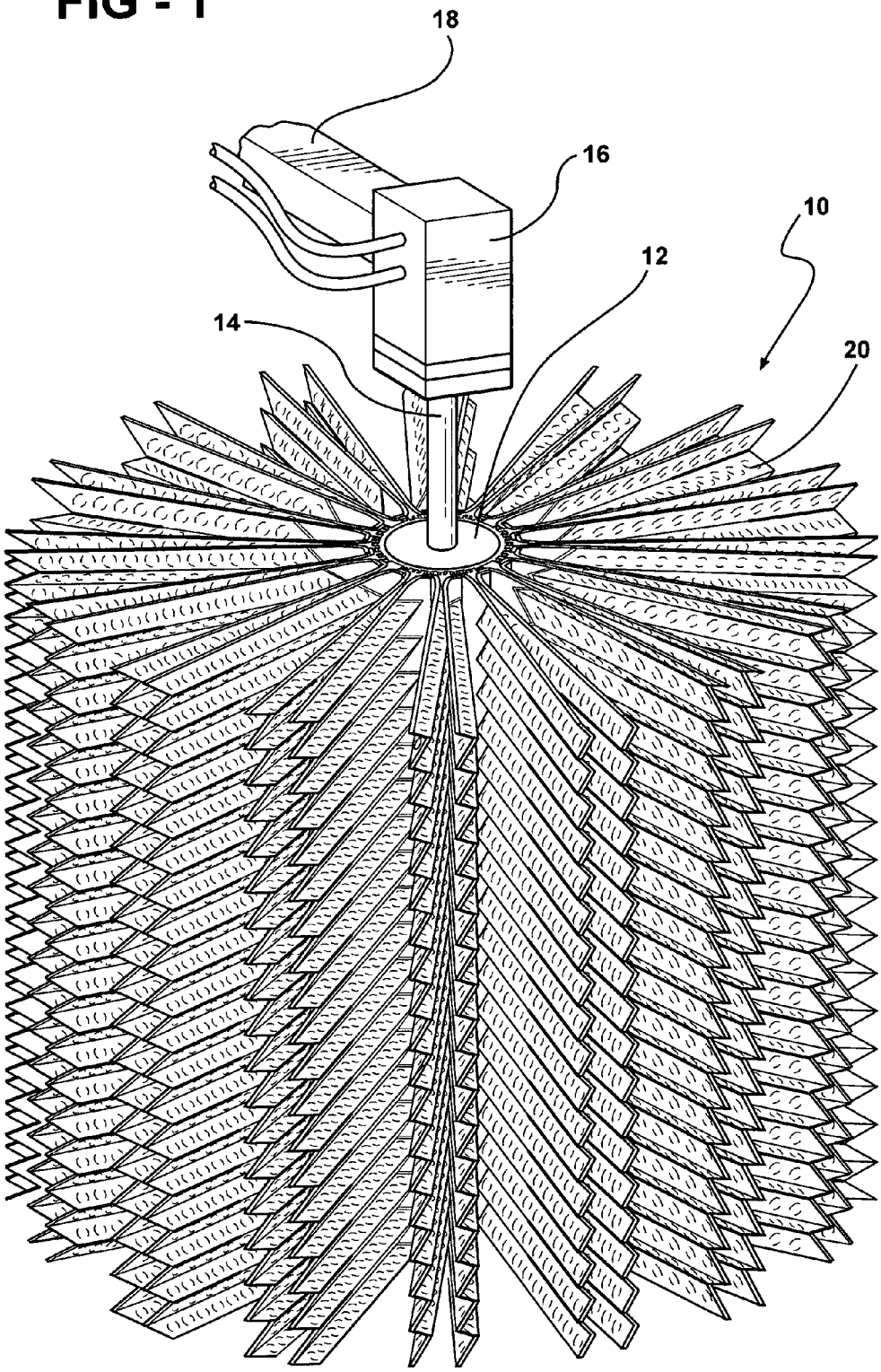
FIG. 1 is a perspective view of a rotatable car wash brush constructed in accordance with the present invention.

FIG. 1 shows a finished product in the form of a rotatable car wash brush 10 having an extruded aluminum axial core structure 12 mounted on a shaft 14, a motor 16 is mounted along with the brush shaft on the end of a pivot arm 18 so that the brush 10 may be moved in to and out of contact with the side surfaces of a vehicle (not shown) to be washed. The brush 10 is made up of a plurality of media sheets 20 secured in angularly spaced order to the core structure 12 by means of structure illustrated in and further described with respect of FIG. 5. As show in FIG. 1, the sheets 20 are made of closed cell, low absorbtivity, foam plastic having a sheet thickness from about ⅛ of an inch to about ½ inch and preferably in the range of ⅛ to ¼ of an inch. In addition, the sheets 20 are partially subdivided into radial fingers 21 and the individual fingers are pleated or folded into a non-planar configuration such that each sheet tends to stand out and retain its non-drooping shape regardless of the orientation of the brush 10 and regardless of whether or not the brush is rotating. The length of the slits between pleats can vary and the slits always run to the outside edge. In addition, the individual sheets are embossed so as to exhibit a pattern of raised dots or circles 34 as hereinafter described in greater detail with reference to FIGS. 4, 6 and 7.

Figure 5:
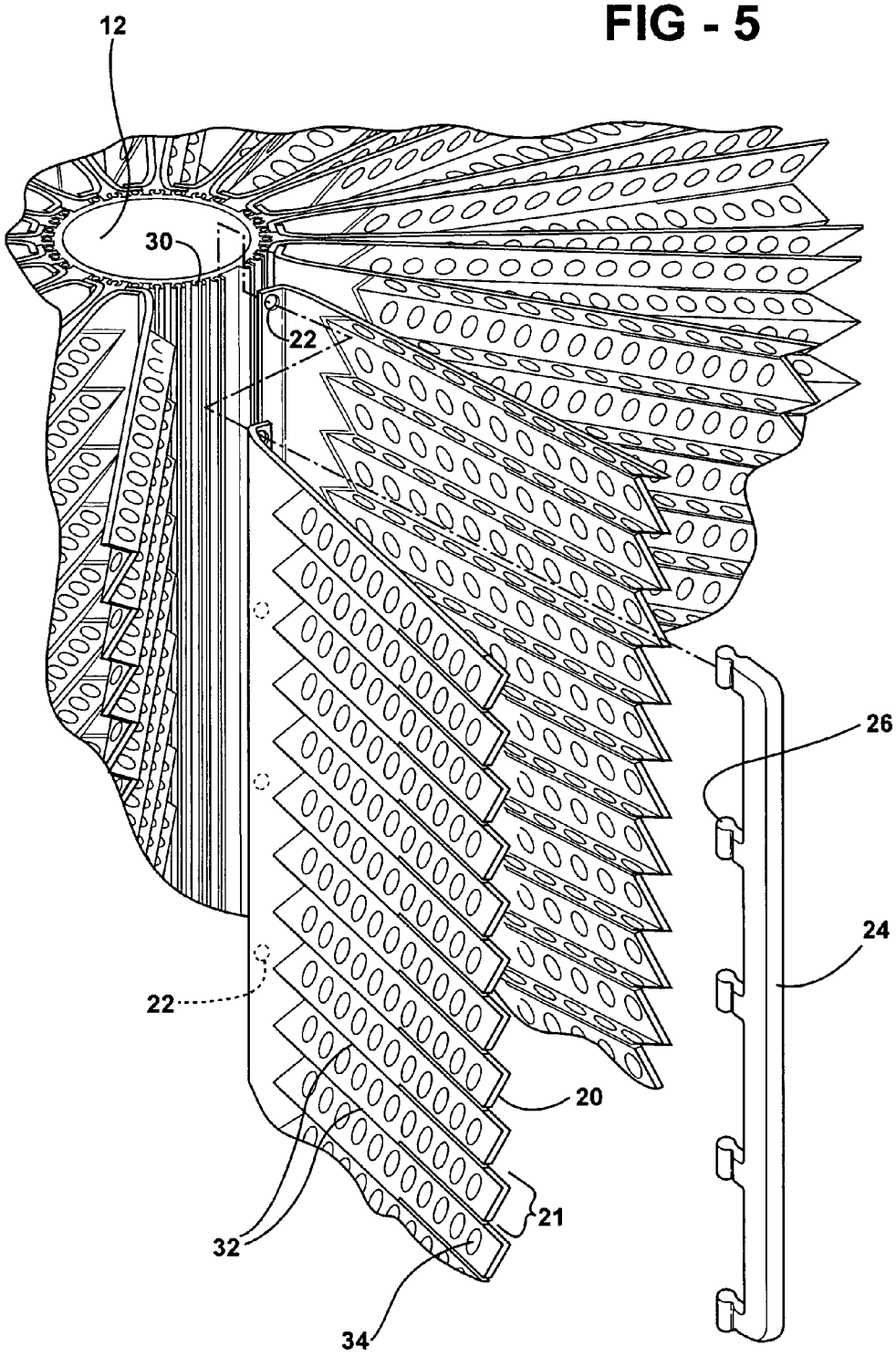
FIG. 5 is a partial perspective view of the brush of FIG. 1 showing the method of assembly essentially using the apparatus and techniques of the U.S. Pat. No. 6,279,190.
Figure 6:
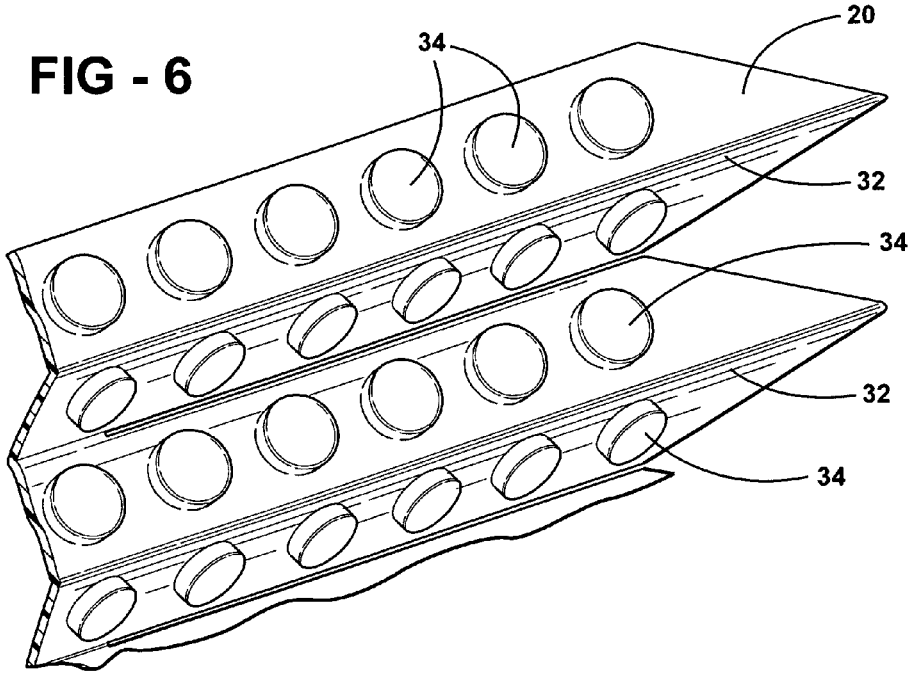
FIG. 6 is a partial perspective view of the media of FIG. 1 as viewed from one side.
Figure 7:
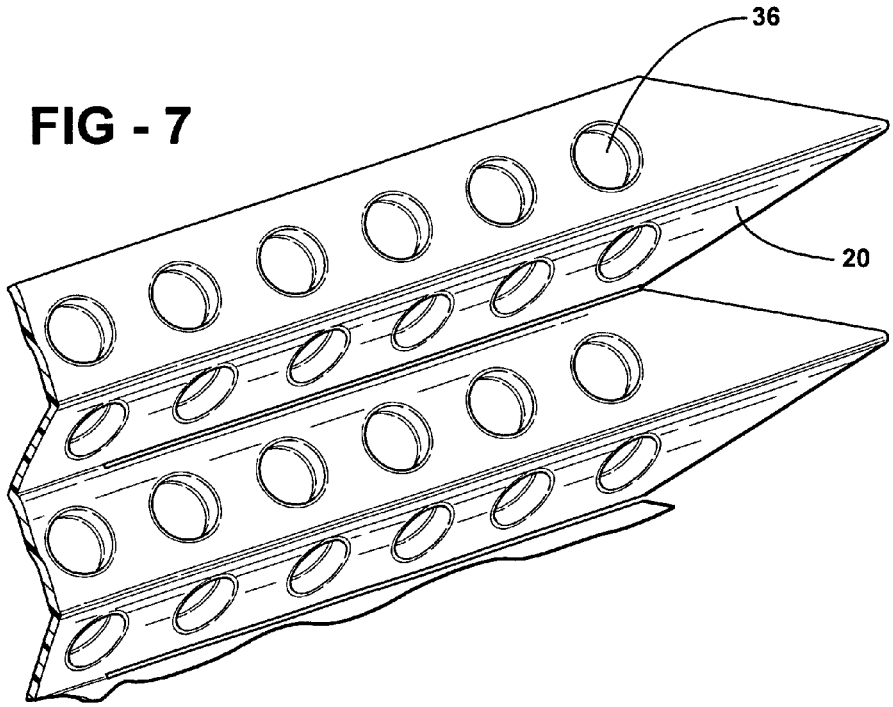
FIG. 7 is a partial perspective view of the media of FIG. 1 when viewed from the other side.

Looking now to FIGS. 5, 6 and 7, the axial core structure 30 is shown to comprise an extruded aluminum tube having channels 30 formed on the outside surface thereof as is disclosed in greater detail in the aforementioned U.S. Pat. No. 6,279,190 the full disclosure of which is incorporated herein by reference. The sheets 20 are provided holes 22 at spaced intervals along the inside edges to receive retainers 24 having heads 26 which penetrate through the holes 22 and then can be entered by sliding into the slots of the core structure 30. The individual fingers 21 are pleated or folded, with the fold line intercepting the outside edge of each finger so that the fingers are non-planar. This geometry gives the individual fingers additional bending strength to hold them in the standout position shown in FIG. 5 even when the brush 10 is not rotating.

As shown in FIG. 6, each finger of the brush media 20 exhibits an embossed geometric pattern comprising raised circles or discs 34 on one side and corresponding depressions 36 on the opposite side. This also contributes non-planarity to the media material. The fold line is shown at 32 and extends all the way to the outside edge which is to the right side of the media material 20 as shown in FIGS. 6 and 7. The slits between fingers are about 6 to 9 inches in radial length.

Figure 4:
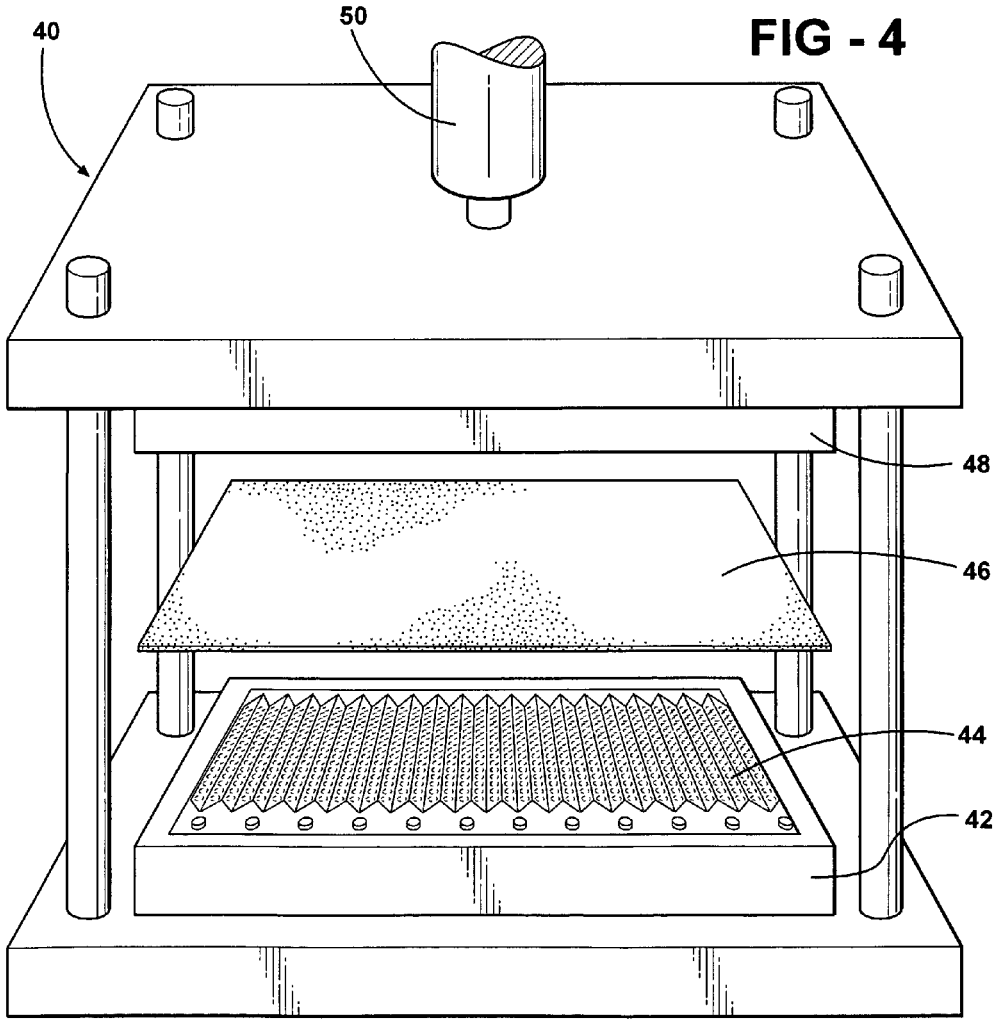
FIG. 4 is a perspective view of a thermoforming press in which the media for the brush of FIG. 1 is being made.

FIG. 4 shows an apparatus for thermoforming polyolefin the media material 20 into one of the various desired shapes. The apparatus shown in FIG. 4 comprises a thermoforming press 40 having a heated lower platen 42, the upper surface of which is engraved with the pattern 44 of the brush media 20. A sheet of thermoformable media material 46 is sized to be placed onto the lower platen 44. An upper platen 48 is dropped down into the appropriate pressing position by means of a mechanism 50. Heat and pressure are applied until the pattern created by the lower platen surface 44 becomes permanently embossed into the media material 46. The fingers are then slit to create the subdivided parallel contiguous finger effect described above and the final product is ready for mounting on the core structure 20. The preferred polyolefin is polyethylene.

It will be understood that the geometry which creates the non-planarity can vary between the simple pleated structure shown in these figures and other configurations including fingers having semicircular cross-sections.

Figure 2:
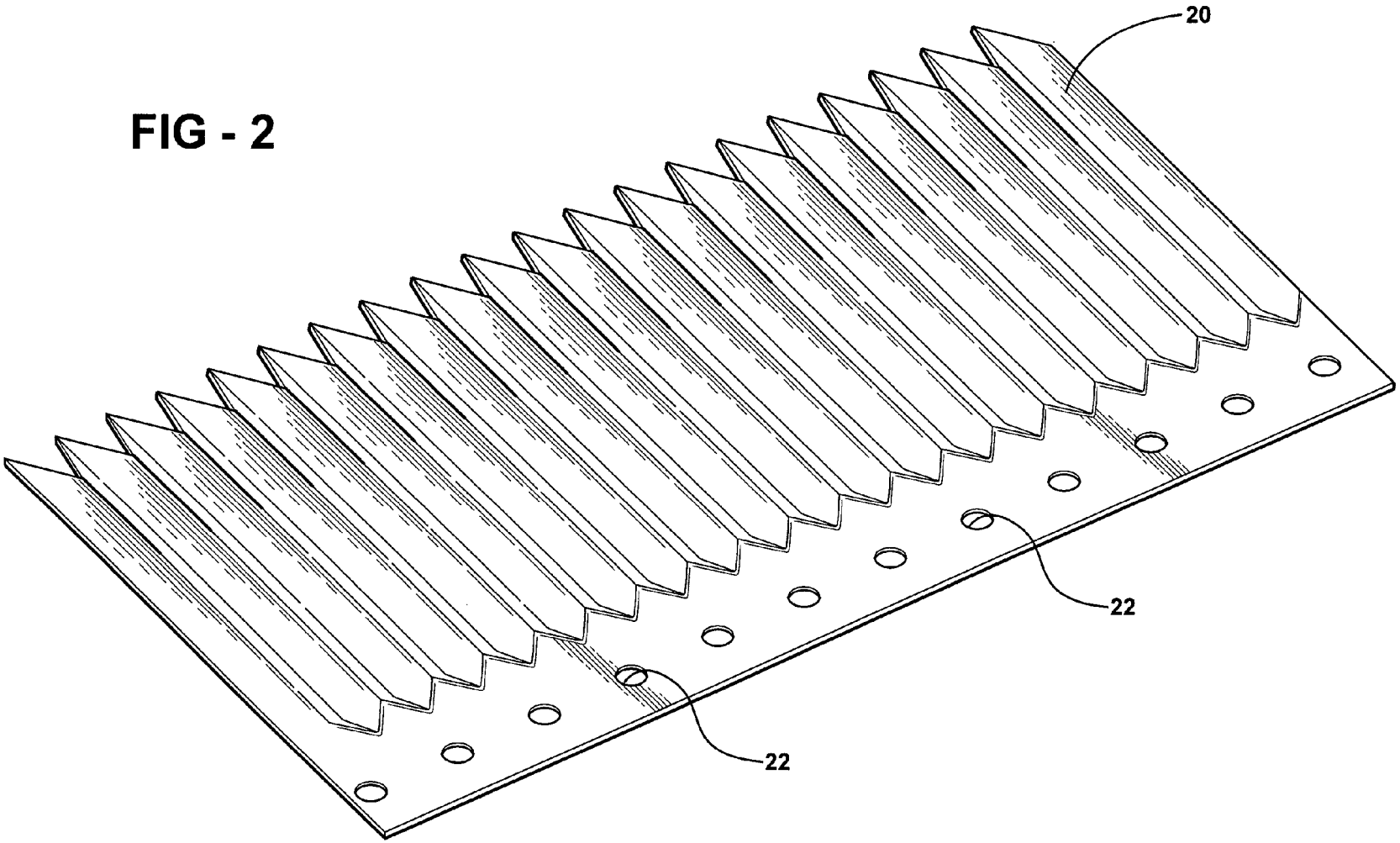
FIG. 2 is a perspective view of a sheet of pleated media for the brush of FIG. 1.
Figure 3:
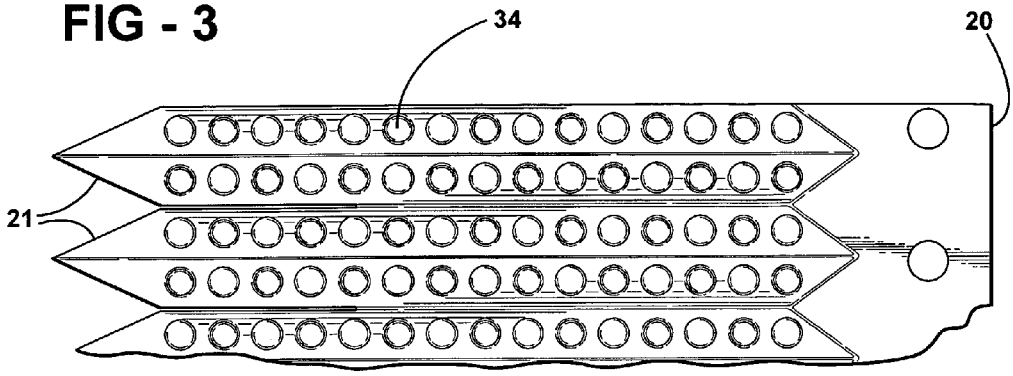
FIG. 3 is a partial plan view of a sheet of pleated and embossed media for the brush of FIG. 1.

It will also be understood that the geometric pattern which in this case includes the circles 34 can vary enormously as between, for example, a waffle pattern of intersecting ridges, straight lines, wavy lines, squares, rectangles and many other patterns which are readily engraved into an aluminum platen and embossed into the thermoformable media. It will also be understood that pleating or the like may be used without the embossed pattern and/or the embossed pattern may be used without pleating, the final selection being made on the basis of the parameter combination which is required to create the shape-retaining stand out brush configuration, the illustrative example of which is found in FIGS. 2 and 5. Without the pleading the material must be thicker.

The inventive method comprises building a brush or other car washing implement using the steps as essentially described above. The first step of course is to provide the core structure 30 or an equivalent. The second step is to prepare the media sheets using the thermoforming method described herein or an equivalent, and the third step is to assemble the thermoformed sheets to the core in angularly spaced order, and complete the assembly necessary to create a functioning brush.

Another inventive method involves the use of the brush so constructed to wash a vehicle. Preferably this method comprises bringing the brush up to a speed of rotation between about 30 and 100 revolutions per minute and thereafter bringing the brush into contact with the outside surface of the vehicle to be washed. Lubricating fluids with and without chemicals are typically applied during this process. The actual speed of rotation of the brush can be as low as about 30 rpm which produces an extremely quiet operation and yet, because of the advantageous configuration and surface pattern of the brush media, does an excellent job of washing the vehicle. Enhanced washing action for dirtier vehicles can be accomplished by increasing the rotation speed.

What is claimed is:

1. A car wash brush designed to be rotated into engagement with an exterior surface of a vehicle in the washing operation comprising:

an elongate support defining an axis of rotation;

a plurality of angularly spaced sheets of low water-absorptivity, closed cell foam plastic material;

said sheets being attached to said support in circumferentially spaced relation to one another and extending parallel to said axis of rotation;

each sheet being at least partially subdivided into substantially parallel radial fingers;

each of said fingers being of non-coplanar, radially pleated configuration;

whereby said fingers tend to be self-supporting irrespective of the orientation of said brush.

2. A car wash brush as defined in claim 1 wherein the material of the fingers is embossed with a pattern having raised and depressed portions.

3. A car wash brush as defined in claim 2 wherein the pattern comprises raised circles.

4. A car wash brush as defined in claim 1 wherein the material is closed cell foam between about ⅛ inch and ½ inch in thickness.

* * * * *